United States Patent [19]

Herring

[11] Patent Number: 4,524,883

[45] Date of Patent: Jun. 25, 1985

[54] STACKABLE CONTAINER

[75] Inventor: Walter R. Herring, Memphis, Tenn.

[73] Assignee: Brockway, Inc., Richmond, Va.

[21] Appl. No.: 508,035

[22] Filed: Jun. 27, 1983

[51] Int. Cl.[3] ..... B65D 21/00; B65D 90/04

[52] U.S. Cl. ..... 220/462; 206/509; 220/465

[58] Field of Search ..... 220/410, 413, 465, 461, 220/404, 416, 418, 463, 462, 23.6; 206/508, 503, 509; 229/DIG. 1, 17 R

[56] References Cited

U.S. PATENT DOCUMENTS

| | | | |
|---|---|---|---|
| 2,412,544 | 12/1946 | Waters | 220/461 |
| 2,721,674 | 10/1955 | Lazard | 220/461 |
| 2,946,494 | 7/1960 | Kuss | 220/465 |
| 3,171,571 | 3/1965 | Daniels | 220/465 X |
| 3,448,889 | 6/1969 | Malpas | 220/465 X |
| 3,458,084 | 7/1969 | Laurizio | 220/465 |
| 4,176,748 | 12/1979 | Beane | 206/503 X |
| 4,280,634 | 7/1981 | Wiesenberger et al. | 220/403 X |
| 4,379,455 | 4/1983 | Deaton | 220/404 X |
| 4,445,550 | 5/1984 | Davis et al. | 220/410 X |

FOREIGN PATENT DOCUMENTS

| | | | |
|---|---|---|---|
| 53310 | 6/1982 | European Pat. Off. | 220/403 |
| 927866 | 6/1963 | United Kingdom | 220/461 |

*Primary Examiner*—Stephen Marcus
*Assistant Examiner*—Robert Petrik
*Attorney, Agent, or Firm*—Walker & McKenzie

[57] ABSTRACT

A container having a substantially rigid box member and a flexible liner member. An attachment member is provided to attach the box member and liner member together so that the attachment member is fixed in the vertical plane with respect to the box member and/or is non-rotatably fixed with respect to the box member. The container is constructed so that a plurality of such containers can be attached one on top of the other.

14 Claims, 19 Drawing Figures

STACKABLE CONTAINER

BACKGROUND OF THE INVENTION

1. Field of the Invention

The present invention relates to stackable containers of the type including a substantially rigid box member and a flexible liner member positioned within the box member.

2. Description of the Prior Art

There are, in general, two types of containers used today to hold flowable substances, such as liquid or powder. The first type is the rigid container, such as, for example, a blow molder plastic container commonly used for industrial and institutional purposes. Such rigid containers have a spout held in a fixed position, both vertically and laterally, to allow for proper engagement of filling nozzles, automatic cappers, and electronic sealers and the like. The second type of container is the so-called "bag-in-box" container comprising a thin, flexible plastic liner positioned in a substantially rigid cardboard box. Such "bag-in-box" containers offer a cost advantage over the rigid containers but have the disadvantage of being difficult to automatically fill and seal, etc. Typically, such "bag-in-box" containers typically include a combination foldable neck and pouring spout, such as disclosed by Winstead, U.S. Pat. No. 3,082,927. The present invention is not disclosed or suggested by the known prior art, taken as a whole.

SUMMARY OF THE INVENTION

The present invention is directed toward improving upon prior containers of the type comprising a substantially rigid box member and a flexible liner member (e.g., a blow molded container or a "bag-in-box" type container). The concept of the present invention is to provide such a container in which the mouth of the flexible liner is held in a fixed position in the vertical plane with respect to the box member.

The container of the present invention comprises, in general, a substantially rigid box member having a hollow interior; a flexible liner member for being positioned within the hollow interior of the box member; and attachment means for attaching the box member and the liner member to one another, the attachment means being fixed in the vertical plane with respect to the box member.

DESCRIPTION OF THE PREFERRED EMBODIMENT

The stackable container 11 of the present invention is intended primarily to hold flowable substances such as liquid or powder. The container 11 comprising, in general, a substantially rigid box member 13 and a flexible liner member 15 for being positioned within the box member 13. An attachment means 17 is provided to attach the box member 13 and liner member 15 to one another.

Figure 1:
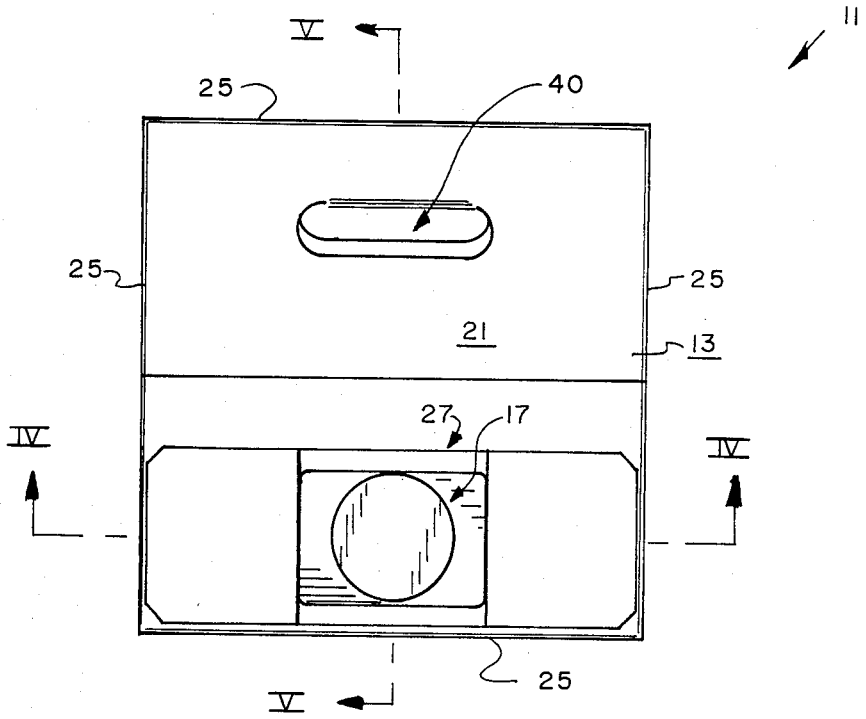
FIG. 1 is a top plan view of the stackable container of the present invention.
Figure 2:
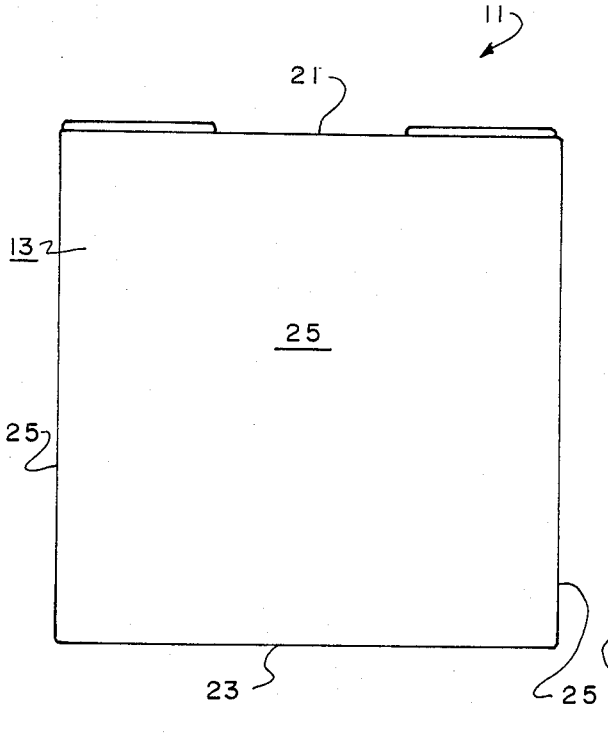
FIG. 2 is a front elevational view thereof.
Figure 3:
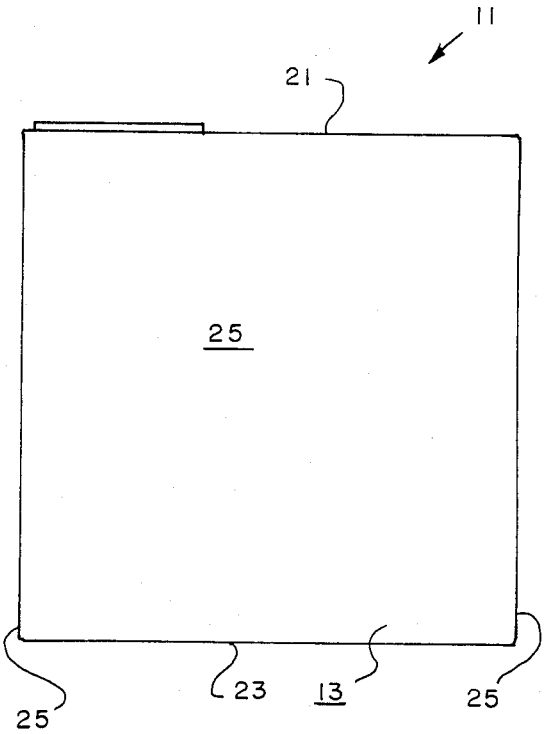
FIG. 3 is a side elevational view thereof.
Figure 4:
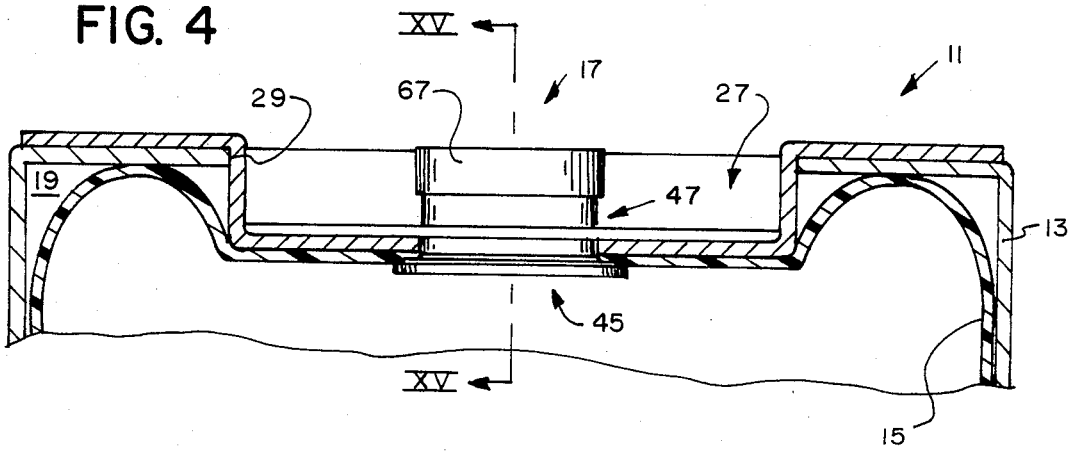
FIG. 4 is an enlarged sectional view substantially as taken on line IV—IV of FIG. 1.
Figure 5:
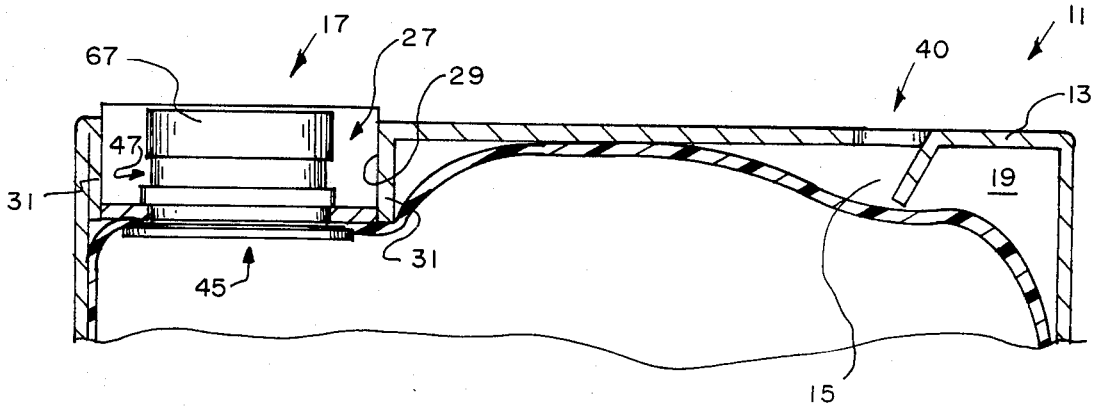
FIG. 5 is an enlarged sectional view substantially as taken on line V—V of FIG. 1.
Figure 6:
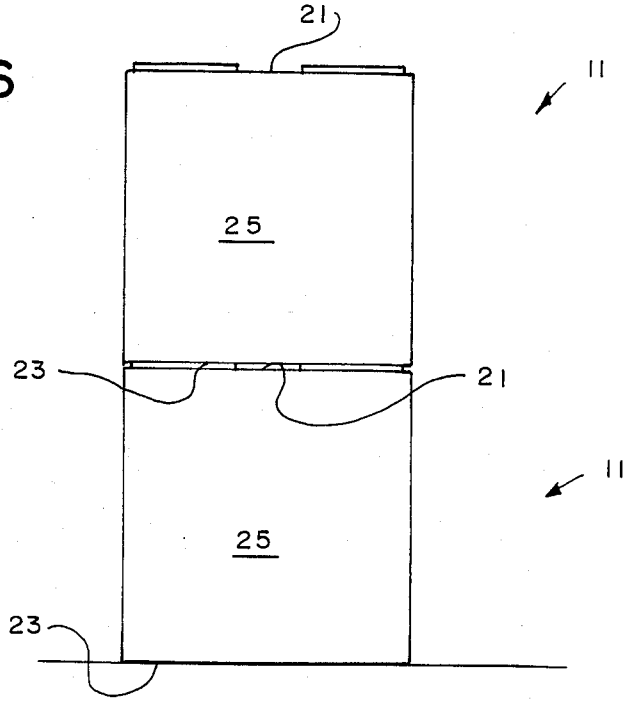
FIG. 6 is a front elevational view of two of the stackable containers of the present invention shown stacked one on top of the other.
Figure 7:
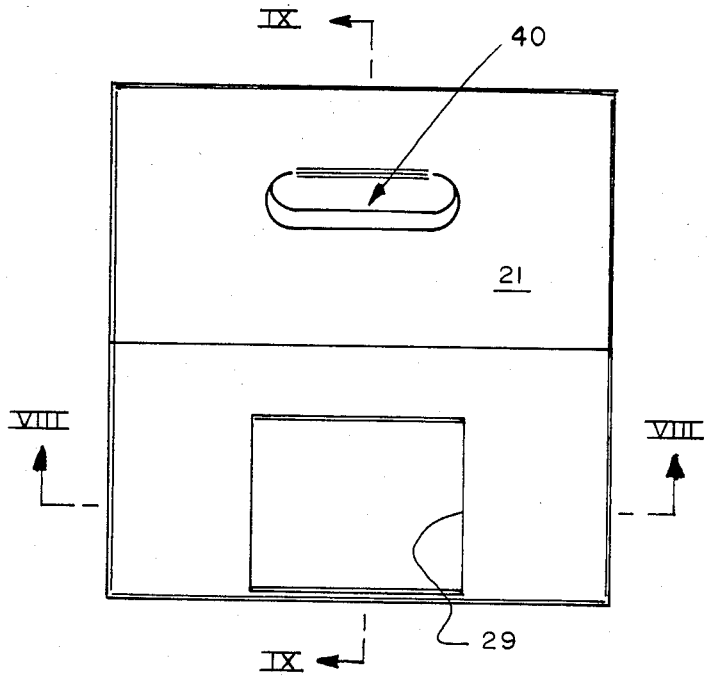
FIG. 7 is a top plan view of a portion of the box member of the stackable container of the present invention.
Figure 8:
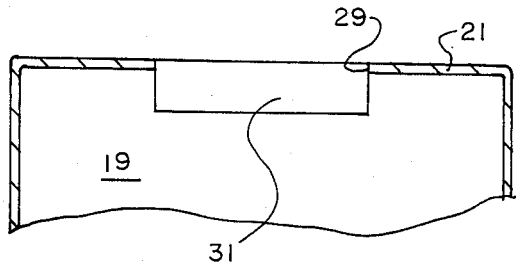
FIG. 8 is a sectional view substantially as taken on line VIII—VIII of FIG. 7.
Figure 9:
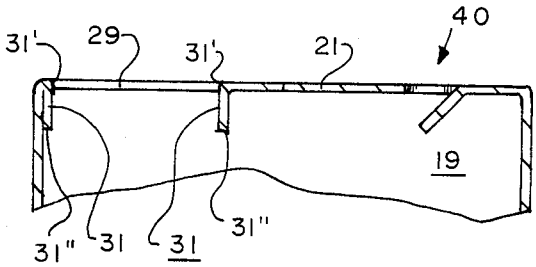
FIG. 9 is a sectional view substantially as taken on line IX—IX of FIG. 7.
Figure 10:
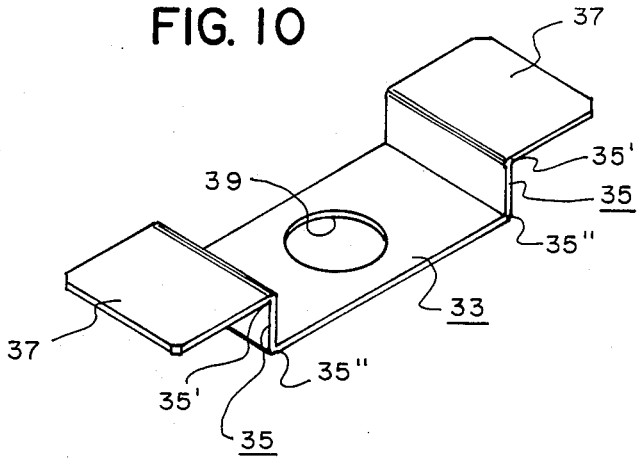
FIG. 10 is a perspective view of another portion of the box member of the stackable member of the present invention.
Figure 11:
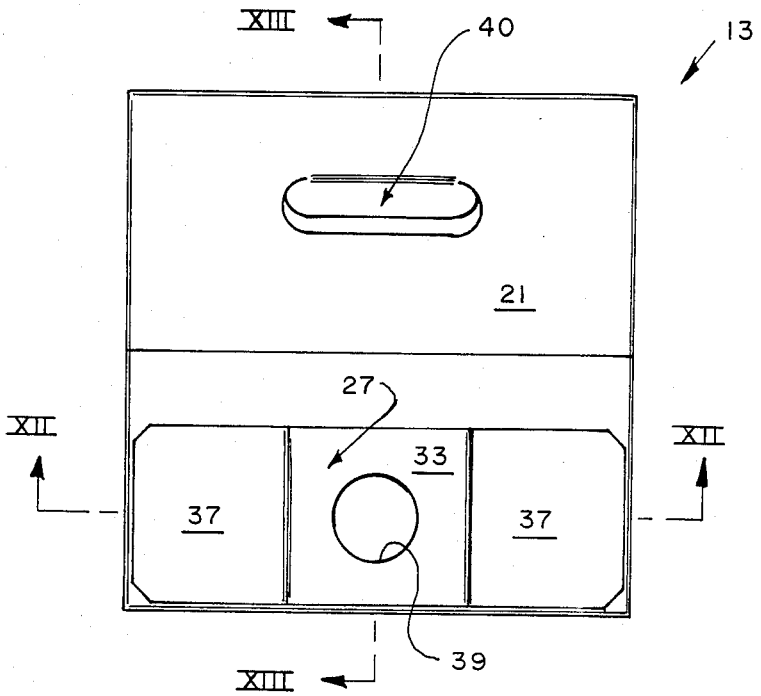
FIG. 11 is a top plan view of the box member of the stackable container of the present invention showing both the portions of FIGS. 7 and 10 attached to one another.
Figure 12:
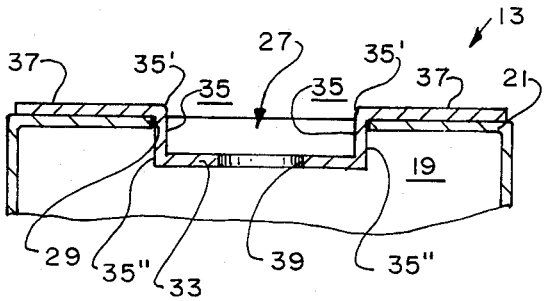
FIG. 12 is a sectional view substantially as taken on line XII—XII of FIG. 11.
Figure 13:
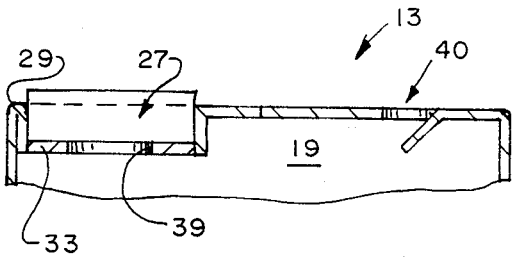
FIG. 13 is a sectional view substantially as taken on line XIII—XIII of FIG. 11.

The box member 13 preferably consists of a substantially typical cardboard box folded and glued from a blank into a cube having a hollow interior 19, a top surface 21, a bottom surface 23, and four side surfaces 25. The specific construction of the box member 13 may be of any typical type well-known to those skilled in the art and need not be described in detail. The top surface 21 preferably includes a stacking surface to allow a plurality of box members 13 to be stacked one on top of the other as shown in FIG. 6 without any interference from the attachment means 17. The stacking surface may consist of raised portions (not shown) provided on the top surface 21. However, the top surface 21 preferably has a recessed portion 27 for receiving the attachement means 17 whereby the attachment means 17 is positioned below the plane of the top surface 21 so that the stacking surface is defined by substantially the entire top surface 21 with the exception of the recessed portion 27. The recessed portion 27 may be defined by a substantially square aperture 29 cut into the top surface 21 as clearly shown in FIGS. 7–9. The box member 13 may include a pair of down-turned flanges 31 on two opposite sides of the aperture 29, as clearly shown in FIGS. 8 and 9. Each flange 31 preferably has an upper end 31' attached to the top surface 21 of the box member 13 and a lower end 31'' extending into the interior 19 of the box member 13 as clearly shown in FIG. 9. A plate member 33 is preferably provided for spanning the distance between the lower ends 31'' of the flanges 31 (see, in general, FIGS. 10–13). The plate member 33 is preferably provided with a pair of arm members 35 attached to opposite sides thereof. Each arm member 35 preferably has an upper end 35′ for being attached to opposite sides of the aperture 29 in the top surface 21 of the box member 13 and lower ends 35″ attached to opposite sides of the plate member 33 (see FIGS. 10 and 12). The upper ends 35″ of the arm members 35 may be attached to the box member 13 in various manners. Preferably, outwardly extending flanges 37 are attached to each upper end 35′ of the arm members 35 for being glued to the top surface 21 of the box member 13 as shown in FIGS. 4 and 12. The plate member 33 preferably has a circular aperture 39 therethrough for reasons which will hereinafter become apparent. The plate member 33, arm members 35 and flanges 37 preferably consist of a single elongated length of cardboard folded in such a manner to define the recessed portion 27 in conjunction with the aperture 29 and flanges 31. A cut-out portion 40 may be provided in the top surface 21 of the box member 13 to provide a convenient handle to allow the container 11 to be easily carried.

The liner member 15 preferably consists of a substantially typical thin-walled plastic container formed of a flexible thermoplastic material or the like to hold flowable material, such as liquids, powders and the like. The container 41 has a mouth 43 for allowing such material to be introduced into and removed from the interior of the container.

The attachment means 17 attaches the box member 13 and liner member 15 to one another. The attachment means 17 is preferably both fixed in the vertical plane with respect to the box member 13 and liner member 15, and non-rotatably fixed with respect to the box member 13 and liner member 15. These features are very important to the present invention. Thus, with the attachment 17 fixed in the vertical plane with respect to the box member 13, the container 11 is especially adapted for automatic filling and sealing procedures. Further, with the attachement means 17 non-rotatably fixed with respect to the box member 13, the container 11 can be used with a screw cap or the like without the danger of tearing the thin liner member 15. The attachment means 17 preferably includes a first lock means 45 and a second lock means 47 for coacting with one another to lock the box member 13 and liner member 15 to one another.

Figure 16:
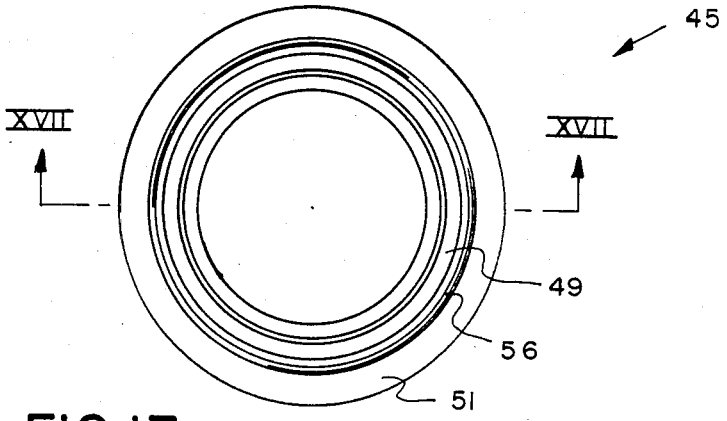
FIG. 16 is a top plan view of one portion of the attachment means of the stackable container of the present invention.
Figure 17:
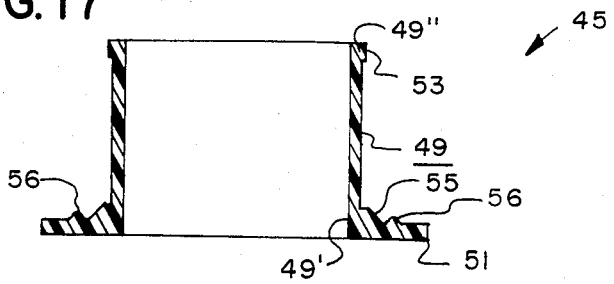
FIG. 17 is a sectional view as taken on line XVII—XVII of FIG. 16.

The first lock means 45 (see, in general, FIGS. 15–17) includes a tube member 49 having a first end 49′ and a second end 49″. The first end 49′ of the tube member 49 has an outwardly extending flange portion 51. The second end 49″ of the tube member 49 has an outwardly extending lip portion 53. A shoulder portion 55 is provided on the tube member 49 directly above the flange portion 51. The outer side of the shoulder portion 55 is preferably angled at 20 degrees for reasons which will hereinafter become apparent. An annular ridge 56 is preferably provided on the flange portion 51 as clearly shown in FIGS. 15–17 for reasons which will hereinafter become apparent. The first lock means 45 may be constructed in various manners now apparent to those skilled in the art. For example, the first lock means 45 can be molded as a one-piece unit out of plastic material or the like.

Figure 18:
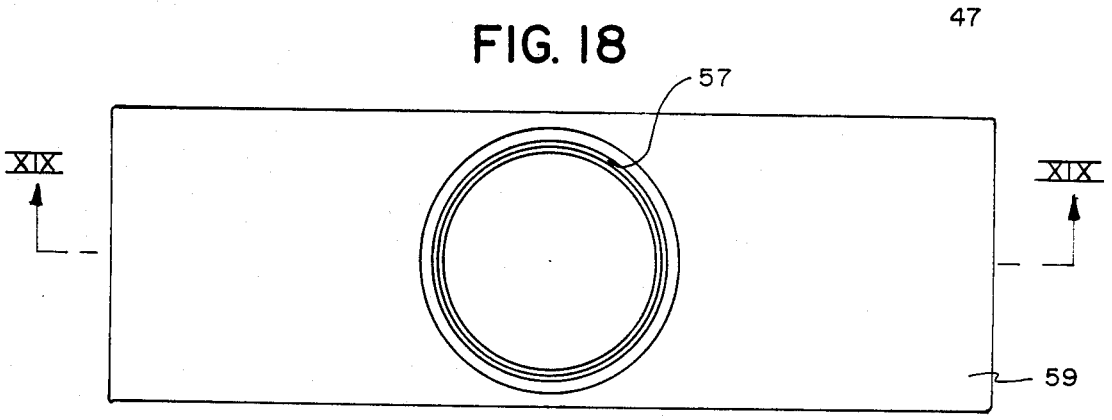
FIG. 18 is a top plan view of another portion of the attachment means of the stackable container of the present invention.
Figure 19:
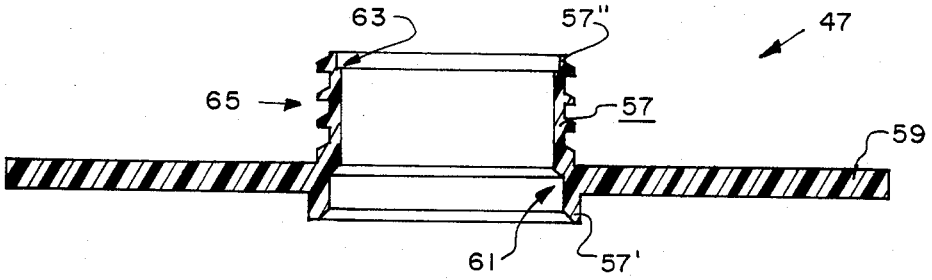
FIG. 19 is a sectional view as taken on line XIX—XIX of FIG. 18.

The second lock means 47 (see, in general, FIGS. 15, 18 and 19) includes a tube member 57 having a first end 57′ and a second end 57″. The tube member 57 has an outwardly extending flange portion 59 located intermediate the first and second ends 57′, 57″. The flange portion 59 is elongated as clearly shown in FIGS. 18 and 19 for reasons which will hereinafter become apparent. The internal side of the first end 57′ of the tube member 59 has a recessed annular portion 61. The lower end of the recessed annular portion 61 is preferably angled at 20 degrees for reasons which will hereinafter become apparent. The second end 57″ of the tube member 59 also has a recessed annular portion 63. External threads 65 are preferably provided on the tube member 57 above the flange portion 59 for reasons which will hereinafter become apparent. The second lock means 47 may be constructed in various manners now apparent to those skilled in the art. For example, the second lock means 47 can be molded as a one-piece unit out of a plastic material or the like.

The container 11 may include a screw-on cap member 67 (see, in general, FIG. 15) for being selectively screwed onto the threads 65 of the second lock means 47 to selectively close the container 11 in a manner which will hereinafter become apparent. The cap member 67 may be constructed in any manner now apparent to those skilled in the art. For example, the cap member 67 may be molded as a one-piece unit out of a plastic material or the like.

Figure 14:
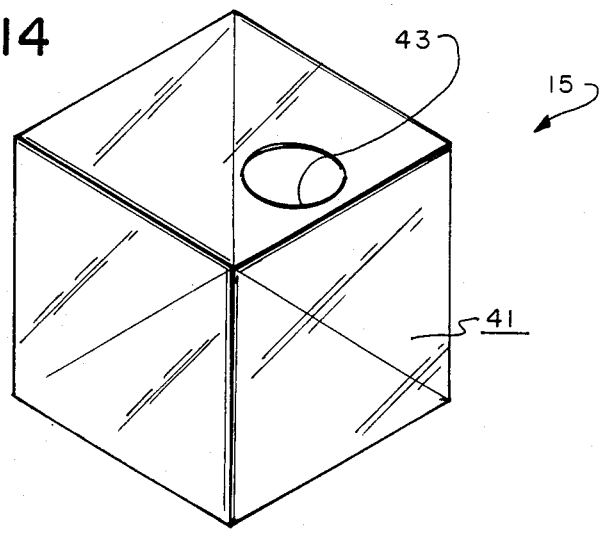
FIG. 14 is a perspective view of the liner member of the stackable container of the present invention.

The container 11 may include a foil seal 69 (see, in general, FIG. 14) for being attached to the second end 49″, 57″ of the tube members 49, 57 of the first and second lock means 45, 47 in a manner apparent to those skilled in the art to seal the container 11 in an airtight manner.

Figure 15:
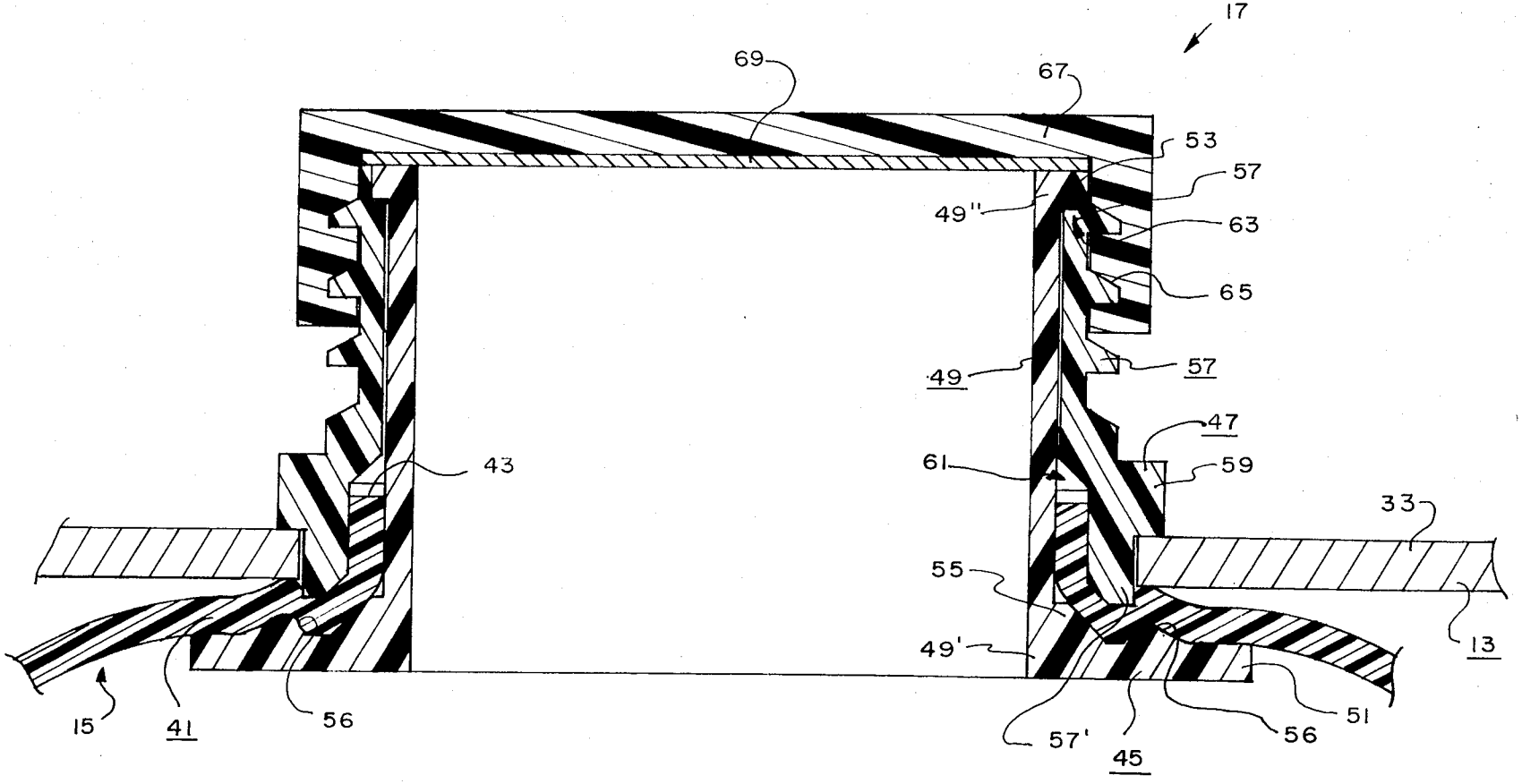
FIG. 15 is an enlarged sectional view substantially as taken on line XV—XV of FIG. 4.

The attachment of the box member 13 and liner member 15 to one another using the attachment means 17 is quite simple. The liner member 15 is placed within the hollow interior of the box member 13 with the mouth 43 of the liner member 15 substantially aligned with the aperture 39 of the plate member 33. The first lock means 45 is positioned in the aperture 39 and mouth 43 with the flange portion 51 located within the hollow interiors of the box member 13 and liner member 15 as clearly shown in FIG. 14. The mouth 43 of the container 41 of the liner member 15 is positioned so that it extends above the shoulder portion 55 of the first lock means 45. The second lock means 47 is positioned within the aperture 39 with the flange portion 59 positioned above the plate member 33 of the box member 13 as clearly shown in FIG. 15. The lip portion 53 of the first lock means 45 and the recessed annular portion 63 of the second lock means 47, and the like, coact to cause the first and second lock means 45, 47 to "snap" together in such a manner so as to secure or position the first and second lock means 45, 47 relative to the plate member 33 of the box member 13 and to securely clamp the mouth 43 of the container of the liner member 13 between the angled shoulder portion 55 of the first lock means 45 and the angled recessed annular portion 61 of the second lock means 47 as clearly shown in FIG. 15. The annular ridge 56 will coact with the first end 57′ of the tube member 57 of the second lock means 47 as shown in FIG. 15 to compress and lock the liner member 13 therebetween. The flange portion 59 coacts with the flange 31 and arm members 35 to define a flange means for abutting a portion of the box member 13 to prevent rotation of the attachment means 17 with respect to the box member 13 and liner member 15 thus preventing the liner member 15 from being torn or the like when the cap member 67 is screwed on or off the attachement means 17. The flange portions 51, 59 coact with the plate member 33 to define a securing means for being secured relative to a portion of the box means 13 to prevent vertical movement of the attachment means 17 with respect to the box member 13 and liner member 15 thus causing the mouth 43 of the container 41 of the liner member 15 to be vertically fixed in position.

As thus constructed, the container 11 provides a "bag-in-box" type of container in which the mouth thereof is held fixed in position to allow the container to be automatically filled and sealed and which will accept screw-type closure means or snap-on closure means or the like without danger of destroying the attachment between the liner and box.

Although the present invention has been described and illustrated with respect to a preferred embodiment thereof and a preferred use therefore, it is not to be so limited since changes and modifications can be made therein which are within the full intended scope of the invention.

I claim:

1. A container comprising:

(a) a substantially rigid box member having a top surface, having a hollow interior and having an aperture through said top surface;

(b) a flexible liner member for being positioned within said hollow interior of said box member and having a hollow interior and having an aperture therethrough; and (c) attachment means for attaching said box member and said liner member to one another, said attachment means being fixed in the vertical plane with respect to said box member, said attachment means including a first lock means and a second lock means that snap together to secure said attachment means to said box member and to clamp said liner member therebetween, said first lock means including a tube member for extending through said aperture in said box member and said aperture in said liner member, said tube member of said first lock means having a first end for being positioned within said interior of said liner member and having a second end for being positioned above said aperture through said box member, said first end of said tube member of said first lock means including an outwardly extending portion for preventing said tube member of said first lock means from freely passing upwardly through said aperture through said box member, said second lock means coacting with said first lock means to lock said tube member of said first lock means to said box member and said liner member, said second lock means including a tube member having a first end and a second end and including an outwardly extending portion for preventing said second lock means from freely passing downwardly through said aperture through said lock member and for coacting with said outwardly extending portion of said first end of said tube member of said first lock means to position said attachment means relative to said box member to prevent vertical movement of said attachment means with respect to said box member, said second end of said tube member of said first lock means having an outwardly extending portion, said tube member of said second lock means and said liner member being secured between said outwardly extending portion of said first end of said tube member of said first lock means and said outwardly extending portion of said second end of said tube member of said first lock means, said first end of said tube member of said first lock means having a wedge portion and said first end of said tube member of said second lock means having a bevel portion for coacting with said wedge portion of said first lock means to securely hold said liner member therebetween.

2. The container of claim 1 in which said attachment means is non-rotatably fixed with respect to said box member.

3. The container of claim 2 in which said box member has a top surface, and in which said top surface of said box member is provided with a stacking surface for stackably receiving another container, said attachment means being positioned beneath said stacking surface so as not to interfere with the stacking of another container thereon.

4. The container of claim 3 in which said securing means prevents vertical movement of said attachment means with respect to said box member.

5. The container of claim 1 in which said outwardly extending portion of said tube member of said second lock means is elongated for abutting a portion of said box member and for preventing rotation of said attachment means with respect to said box member.

6. The container of claim 1 in which said second end of said tube member of said second lock means has a recess portion for receiving said outwardly extending portion of said tube member of said first lock means.

7. The container of claim 6 in which said first end of said tube member of said second lock means has a recess portion for receiving a portion of said liner member.

8. The container of claim 3 in which said cap means is screwably attached to said second end of said tube member of said second lock means to close said aperture through said liner member.

9. The container of claim 8 in which said tube member of said second lock means is provided with external threads, and in which said cap means is provided with internal threads for being screwably attached to said second end of said tube member of said second lock means.

10. The container of claim 9 in which said top surface of said box member is divided into a raised portion and a recessed portion with said raised portion defining said stacking surface.

11. The container of claim 10 in which said raised portion of said top surface of said box member has an aperture therethrough, and in which said top surface of said box member includes a plate member having a pair of arm members, each arm member having an upper end for being attached to opposite sides of said aperture through said raised portion and having a lower end, said plate member having a body member attached to said lower ends of said arm members and extending across said aperture through said raised portion to define said recessed portion of said top surface of said box member.

12. The container of claim 11 in which said aperture through said top surface of said box member through which said tube member of said first lock means extends is located on said body member of said plate member of said top surface of said box member.

13. The container of claim 12 in which said outwardly extending portion of said tube member of said second lock means is substantially rectangular in plan and abuts said arm members of said plate member of said top surface of said box member to prevent rotation of said attachment means with respect to said box member.

14. The container of claim 1 in which said outwardly extending portion of said first end of said tube member of said first lock means has an annular ridge for coacting with said first end of said tube member of said second lock means to compress and lock said liner member therebetween.

* * * * *